United States Patent [19]

deOrbegoso et al.

[11] Patent Number: 4,893,821

[45] Date of Patent: Jan. 16, 1990

[54] SCORING SYSTEM FOR GAME APPARATUS

[75] Inventors: Mariano deOrbegoso; Jane Moe, both of Sheridan; Chris Masterson, Beaverton, all of Oreg.

[73] Assignee: Non Plus Ultra, Inc., Sheridan, Oreg.

[21] Appl. No.: 190,712

[22] Filed: May 6, 1988

[51] Int. Cl.[4] ..... A63F 7/30

[52] U.S. Cl. ..... 273/371; 273/123 A; 273/126 A

[58] Field of Search ..... 273/371, 352, 118 A, 273/118 D, 119 A, 122 A, 123 A, 124 A, 125 A, 126 A, 142 B, 121 A; 194/239; 453/4

[56] References Cited

U.S. PATENT DOCUMENTS

| | | | |
|---|---|---|---|
| 827,626 | 7/1906 | Gillett | 273/402 |
| 1,906,260 | 5/1933 | Gibbs | 273/123 A |
| 2,520,460 | 8/1950 | Ford . | |
| 2,977,429 | 3/1961 | Zimmerman | 273/371 |
| 4,531,625 | 7/1985 | Yonekura et al. | 453/4 |

FOREIGN PATENT DOCUMENTS

| | | | |
|---|---|---|---|
| 319418 | 11/1902 | France . | |
| 520306 | 3/1955 | Italy | 273/371 |
| 566245 | 8/1957 | Italy . | |
| 631209 | 12/1961 | Italy . | |
| 652307 | 2/1963 | Italy | 273/402 |
| 1075250 | 7/1967 | United Kingdom | 273/371 |

OTHER PUBLICATIONS

One photograph labeled "A", depicting a prior art game having no associated or similar scoring system.

*Primary Examiner*—Edward M. Coven
*Assistant Examiner*—Valerie Szczepanik
*Attorney, Agent, or Firm*—Stoel Rives Boley Jones & Grey

[57] ABSTRACT

A game apparatus receives tokens pitched toward it and provides a score corresponding to the number and location of tokens it receives. The apparatus includes a box-like frame (20) that carries a horizontally disposed target board (22). The target board (22) includes a plurality of openings (38) formed therein. The openings (38) are arranged in a matrix of multiple rows and multiple columns and configured to receive the tokens (42) pitched into them. Beneath the target board (22) are a plurality of chutes (40), one chute associated with each opening (38). Within each chute (40) there is a token guide mechanism (54) for directing any coin-like tokens (42) received in that chute through a detection passage (60). A sensor (88) is mounted to each token guide mechanism (54) for detecting the presence of a token (42) within the detection passage (60), the presence of the token being indicated by a detection signal applied to the sensor output. A microcontroller (100) and associated signal processing circuitry scans each row of sensors (88) and during the scan of each row reads the sensor outputs to determine whether a token (42) is present in any of the chutes (40) of the scanned row. The microcontroller (100) continually compiles and revises a score corresponding to the number of tokens (42) passing through each of the openings (38), and to the particular location of each of the openings (38) into which a token is pitched.

4 Claims, 2 Drawing Sheets

SCORING SYSTEM FOR GAME APPARATUS

TECHNICAL FIELD

This invention relates to a game apparatus and associated scoring system.

BACKGROUND INFORMATION

The prior art includes a variety of games designed to receive tokens that are pitched toward selected targets. The targets may be openings of various shapes or sizes, and each opening is assigned a numerical score. Usually, the openings that are most difficult to "hit" with a token carry the highest score.

Games such as just described often require manual score tallying. Further, the rules of play for some games require each player to pitch a series of tokens during one turn, and to compile a score at the end of the turn.

It can be appreciated that manual tallying of the game score can be tedious and can delay the game progress. It is desirable, therefore, to provide a game with an accurate and rapidly responsive automatic scoring system that eliminates the tedium of manual scoring.

SUMMARY OF THE INVENTION

This invention is directed to a game apparatus with an automatic scoring system that tallies and displays a score. The game apparatus particularly comprises a box-like frame that carries a horizontally disposed target board. The target board includes a plurality of openings formed therein for receiving tokens. The openings are arranged in a matrix of multiple rows and multiple columns. Beneath the target board are a plurality of chutes, one chute associated with each opening. Within each chute there is a token guide mechanism for directing any coin-like tokens received in that chute through a detection passage. A sensor is mounted to each token guide mechanism for detecting the presence of a token within the detection passage, the presence of the token being indicated by a detection signal applied to the sensor output.

A microcontroller with associated signal processing circuitry scans each row of sensors. As each row of sensors is scanned, the microcontroller reads the sensor outputs to determine whether a token has passed through any of the chutes of the scanned row. The microcontroller continually compiles and revises a score corresponding to both the number of tokens passing through each of the openings, and to the particular location of each of the openings into which a token is pitched.

As an aspect of this invention, the sensors, microcontroller and associated signal processing circuitry are adapted to ensure that a single token is not counted more than once in compiling the score.

As another aspect of this invention the token guide mechanism and sensors are arranged to provide signals that clearly indicate the presence of two or more tokens moving through the detection path, even if the tokens are sliding together in tandem.

FIG. **5*a*** is a schematic representation of an exemplary sensor of the scoring control system.

DETAILED DESCRIPTION OF PREFERRED EMBODIMENT

Figure 1:
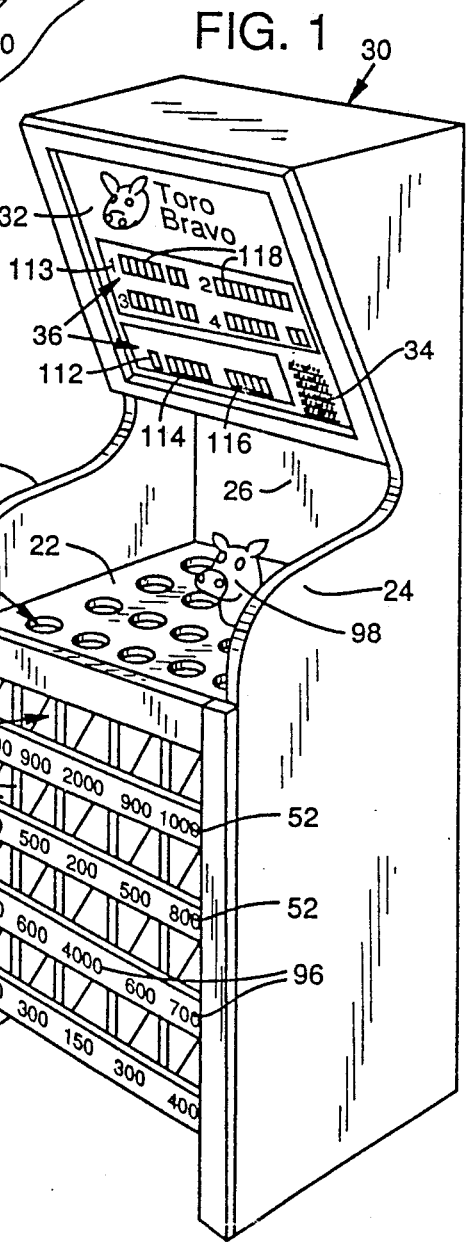
FIG. 1 is an isometric view of the game apparatus formed in accordance with this invention.

With reference to FIG. 1, a game apparatus formed in accordance with this invention includes a generally box-shaped frame 20, the top of which carries a flat, horizontally disposed target board 22. The sidewalls 24 and the backwall 26 of the frame 20 extend upwardly beyond the target board 22 and form part of a cabinet 30 that houses the primary components of a scoring control system that is described below. The front of the cabinet 30 carries a display board 32. The display board 32 includes printed matter 34 (game rules, etc.) and changeable displays 36 for indicating game and score information.

Circular openings 38 are formed through the target board 22. The openings 38 are evenly spaced apart and arranged in a four-row by five-column matrix. Where convenient, the openings 38 will be hereafter individually designated, in accordance with conventional matrix notation, as $O_{m,n}$. The subscript m represents the row number (row 1 being the row near the front 23 of the game, wherein each row of openings extends in a line substantially parallel to the backwall 26 as shown in FIG. 1), and the subscript n represents the column number (column 1 being the left-most column as viewed in FIG. 1).

Figure 2:
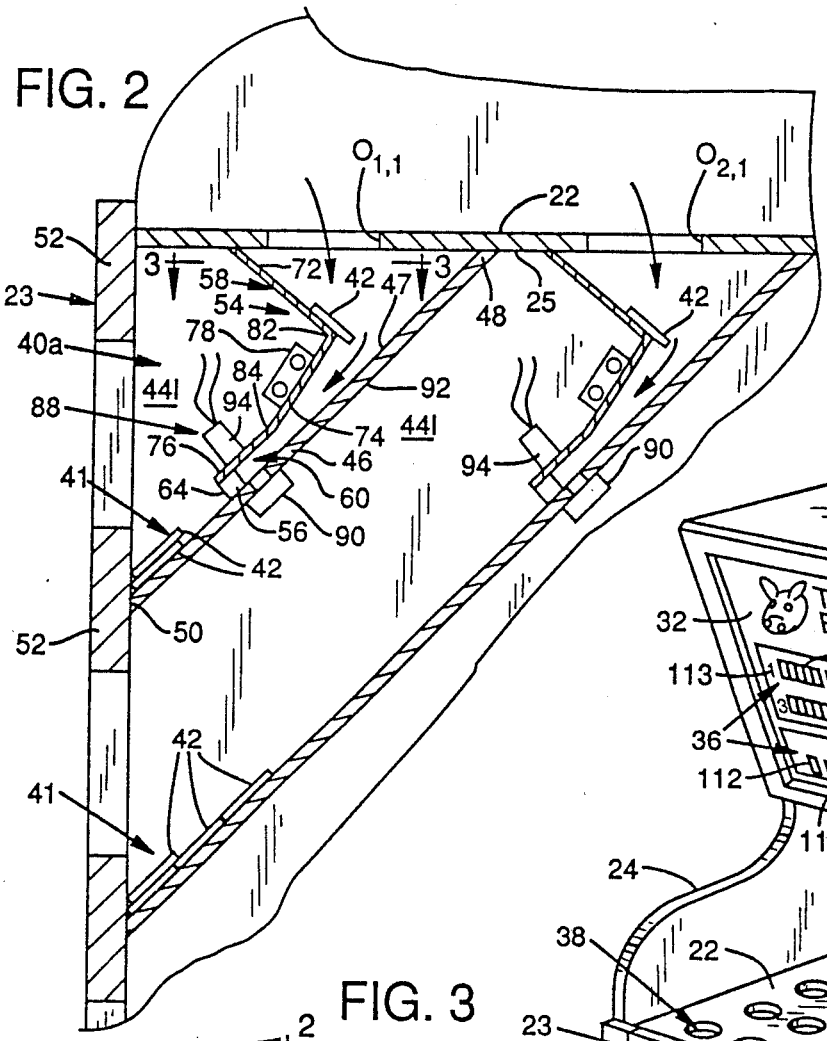
FIG. 2 is a side cross-sectional view taken along line 2—2 of FIG. 3, illustrating chutes for receiving tokens pitched through openings in the target board of the game.

A plurality of chutes 40 are housed within the frame 20 beneath the target board 22. Each chute 40 has an upper end that is positioned immediately beneath an associated opening 38 in the target board. The chute 40 transports to its lower end 41 coin-like tokens 42 (one of which is shown in FIG. 2) that are pitched into the associated opening 38. The vertical sides of each column of chutes 40 are defined by a pair of apart-spaced parallel column walls 44 that are mounted within the frame 20 parallel to and between the frame sidewalls 24. Six column walls 44 are used to define the vertical sides of the five columns of chutes 40. Each outermost column wall 44 is fastened to an adjacent sidewall 24 of the frame 20.

Figure 3:
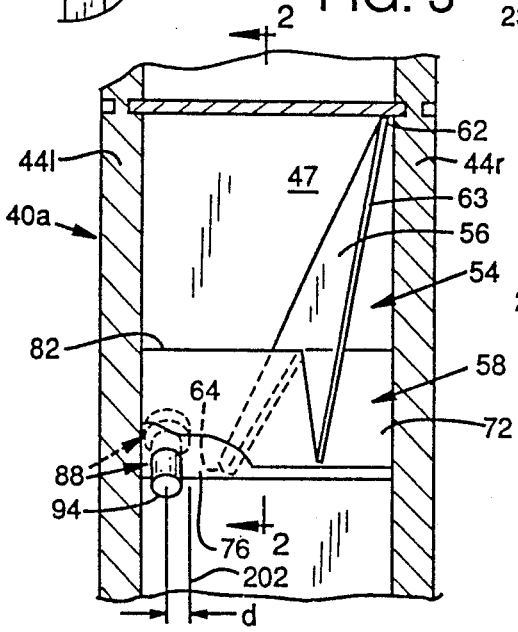
FIG. 3 is a top view taken along the line 3—3 of FIG. 2 indicating an exemplary chute with associated token guide mechanism.
Figure 4:
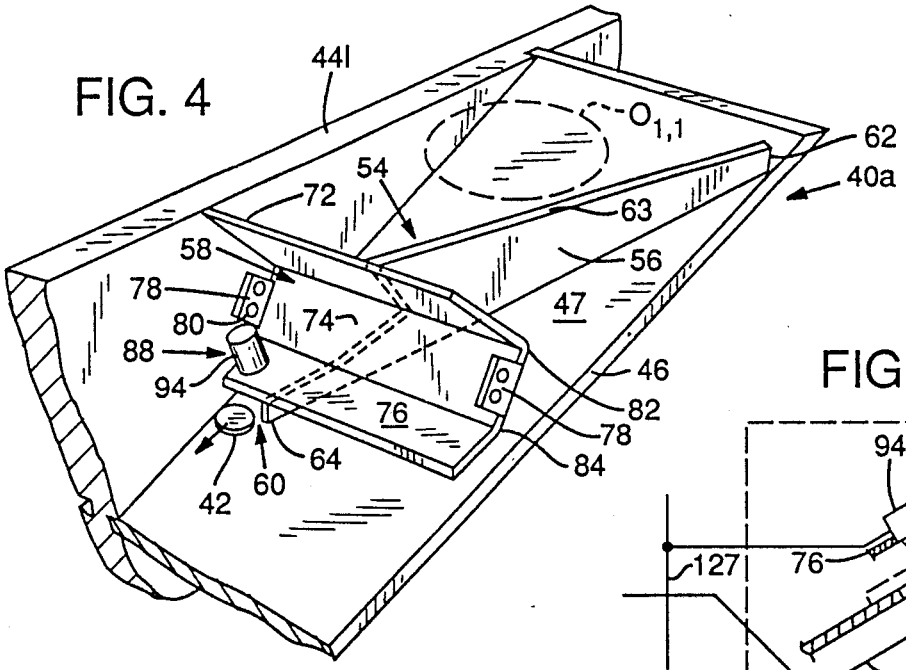
FIG. 4 is an isometric view of the exemplary chute with guide mechanism.

The following is a description of a single exemplary chute, which is identified as the chute **40*a* shown in FIGS. 2–4. Chute 40*a* lies generally beneath the opening $O_{1,1}$ and has a flat bottom plate 46 that extends beneath the chute opening $O_{1,1}$ between the pair of column walls 44*l*, 44*r* that define the particular column of chutes to which chute 40*a* belongs. The bottom plate 46 is attached so that its upper end 48 is adjacent to the underside 25 of the target board 22. The upper end 48** is located to the rear of the associated opening $O_{1,1}$, but forward of the opening $O_{2,1}$ in the adjacent rearward row of openings.

The bottom plate 46 is inclined downwardly and forwardly, and its lower end 50 joins one of five apart-spaced, elongated cross members 52 that extend continuously across the front 23 of the frame 20 between the sidewalls 24. Any token 42 that is pitched into the opening $O_{1,1}$ eventually contacts the bottom plate 46 of the chute 40*a* and slides down to the lower end 50 of the bottom plate until it is stopped by the cross member 52 to which the bottom plate 46 is attached. Spacing between the cross members 52 is such that the player can reach between cross members to retrieve tokens 42 stopped at the chute lower end 41.

With continued reference to the exemplary chute 40*a*, a guide mechanism 54 is incorporated within the chute for directing each token 42 through a particular path so that the presence of the token within the chute can be detected. The preferred guide mechanism 54 includes a transverse guide 56 and a drop guide 58 that combine to define a detection passage 60 through which any tokens 42 pitched into the chute 40*a* must pass.

Specifically, the transverse guide 56 is a sheet of rigid material, such as steel, that extends between the upper surface 47 of the chute bottom plate 46 and the underside 25 of the target board 22, and from the upper end 48 of the bottom plate 46 to a location forward (i.e., relative to the front 23 of the frame 20) of the opening $O_{1,1}$. The rearwardmost end 62 of the transverse guide 56 is located near one column wall 44*r* of the pair of column walls that define the vertical sides of the chute 40*a*. The transverse guide 56 extends across the bottom plate 46 so that the forwardmost end 64 of the transverse guide is near the column wall 441 that defines the opposing vertical side of the chute 40*a*. The passage 60 between the forwardmost end 64 of the transverse guide 56 and the adjacent column wall 441 is sized slightly larger than a token 42, thereby permitting a token to slide through the passage 60.

The transverse guide 56 is inclined to the upper surface 47 of the bottom plate 46 so that as viewed from above (FIG. 3), the edge 63 of the transverse guide 56 that is adjacent to the underside 25 of the target board 22 is substantially between the opening $O_{1,1}$ and the column wall 44*r*. As a result of the configuration of the transverse guide 56 just described, tokens 42 that pass through the opening $O_{1,1}$ will be directed by that guide 56 toward the passage 60 of the chute 40*a*.

The drop guide 58 is a sheet of rigid material, such as steel, that is bent into three contiguous flat sections: an upper section 72; an intermediate section 74; and a lower section 76. The upper section 72, intermediate section 74, and lower section 76 extend between the chute column walls 44*l*, 44*r*. The drop guide 58 is held in position within the chute 40*a* by suitable attachment means, such as the illustrated brackets 78 and fasteners 80 that secure the drop guide 58 to the column walls. The drop guide 58 intersects the transverse guide 56. The edge of the transverse guide 56 that intersects the drop guide 58 is shaped to match the cross-sectional configuration of the drop guide 58. The transverse guide 56 and drop guide 58 are joined by suitable means, such as spot welding.

With reference to FIG. 2, the drop guide 58 is shaped such that the upper section 72 thereof extends from the underside 25 of the target board 22 to a bend 82 that is spaced from the upper surface 47 of the chute bottom plate 46. The upper section 72 is inclined to be approximately perpendicular to the chute bottom plate 46 and directs tokens 42 that pass through opening $O_{1,1}$ toward the bottom plate 46.

The intermediate section 74 of the drop guide 58 extends from the first-mentioned bend 82 to a forward bend 84 that is spaced away from the upper surface 47 of the bottom plate 46. As viewed in the cross section of FIG. 2, the intermediate section 74 converges toward the bottom plate 46 in the direction from the first bend 82 toward the forward bend 84. The intermediate section 74 is spaced from the bottom plate 46 a distance short enough to ensure that any token passing beneath the intermediate section will be forced to slide along a flat side (i.e., as opposed to rolling) as it moves toward passage 60.

The lower section 76 of the drop guide 58 extends parallel to the upper surface 47 of the bottom plate 46 from the forward bend 84 to a point adjacent to the location of the forwardmost end 64 of the transverse guide 56. A portion of the lower section 76 of the drop guide covers the passage 60.

A two component sensor 88 is mounted within the chute 40*a* and is used as part of scoring control system for determining whether a token 42 has slid through the passage 60. The preferred sensor 88 includes a conventional infrared light emitting diode ("emitter") 90 mounted to the underside 92 of the chute bottom plate 46 beneath the passage 60. A conventional infrared photodetector ("detector") 94 is mounted to the portion of the lower section 76 of the drop guide 58 that covers the passage 60. A suitable emitter 90 is a Model No. OP-160 SLA manufactured by TRW Corporation. A suitable detector 94 is a Model No. OP500 SLA, manufactured by TRW Corporation.

The detector 94 is positioned across from the emitter 90. As described hereafter, the infrared light produced by the emitter 90 passes through the detection passage 60 and is detected by the detector 94. The detector output is scanned by the scoring control system as will be described more fully below.

All of the chutes 40 and sensors 88 are substantially identical to the exemplary chute 40*a*just described, except that chutes of each successive row of chutes require relatively longer bottom plates 46 so that the chutes extend continuously from their associated openings 38 to the particular cross member 52 that provides the lower terminus of the chute.

Each opening 38 is assigned a numerical score 96, which appears on the cross member 52 at the lower end of each associated chute 40 (FIG. 1). Preferably, a figurine 98 is mounted to the target board 22 over one opening $O_{3,3}$. The figurine 98 may be, for example, a bull having an open mouth for receiving tokens 42. The tokens that enter the mouth fall into the opening $O_{3,3}$ over which the bull 98 is mounted. Preferably, the highest score is assigned to that opening $O_{3,3}$.

Figure 5A:
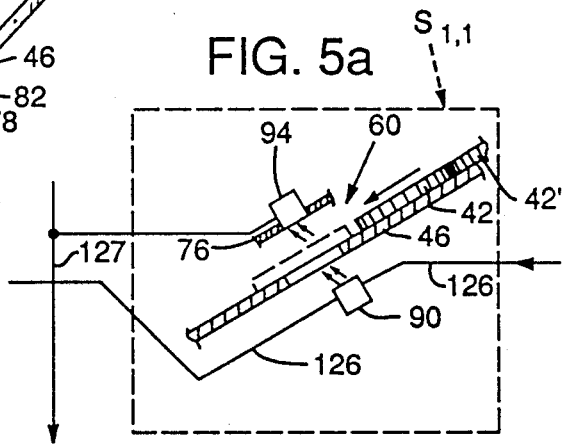
FIG. 5 is a schematic representation of the scoring control system of the game apparatus of the present invention.
Figure 5:
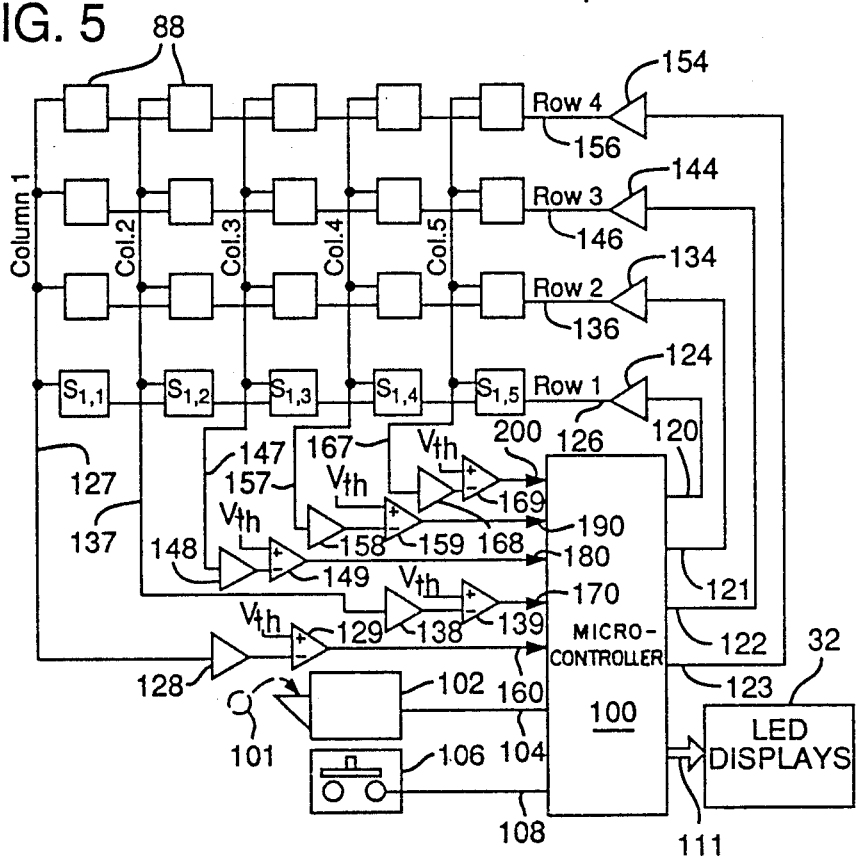

Turning now to the scoring control system shown schematically in FIG. 5 and 5*a*, the matrix of sensors 88 (where hereafter convenient, the sensors will be individually designated $S_{m,n}$ in accordance with the matrix notation mentioned earlier) is rapidly scanned during a player's turn to determine whether a token 42 has passed into an opening 38 and through a detection passage 60. The score associated with the opening through which a token passes is awarded to the player and displayed.

More particularly, the scoring control system comprises a microcontroller 100, such as an Intel 8748. The operation of the scoring control system is initiated whenever coins 101 are detected by a conventional coin mechanism 102, the output of which is transmitted to an input port 104 of the microcontroller 100. The coin mechanism 102 produces an output signal indicative of the amount of money deposited therein, which signal is decoded by the microcontroller 100 to establish the number of participating players.

After a sufficient amount of money is deposited into the coin mechanism 102, an individual player's turn will be initiated whenever a player control switch 106 is depressed. The output of the player control switch is received at an input port 108 of the microcontroller 100. The microcontroller responds by resetting the values of three internal registers that store the game round number (reset to 1), game timer (reset to a preselected maximum game time), and the individual player's score for that particular round (reset to 0). The contents of these three registers are simultaneously converted by conventional BCD-to-seven segment decoders and transmitted for display on the display board 32 via data bus 111. Preferably, a one digit light emitting diode (LED) 112 displays the player round number, a four digit LED 114 displays the game timer value, and a five digit LED 116 displays the score for each round. The score for each round is transferred into the particular player's total score LED display 118 after each round of play.

After the player control switch 106 is depressed, the microcontroller 100 counts down a preselected delay period before beginning to scan the sensors 88. The delay period permits the player to retrieve any tokens 42 remaining in the chutes 40 from the previous round. At the end of the delay period, the microcontroller 100 provides an output signal for illuminating a player number indicator 113 and a "start" indicator (not shown) on the display board 32.

The microcontroller 100 is programmed to sequentially scan each row of sensors 88 by activating the emitters 90 of the selected row, while simultaneously checking the outputs of all of the detectors 94 of the selected row of sensors to determine whether a token has passed through the detection passage 60 of any chute 40 of that row. In this regard, a +5 volt scanning pulse is output via port 120 of the microcontroller 100 to a current amplifier 124. The output of the current amplifier is applied to the first row of emitters 90 via row line 126. Row line 126 is serially connected to the emitters 90 of sensors $S_{1,1}$, $S_{1,2}$, $S_{1,3}$, $S_{1,4}$ and $S_{1,5}$ of row 1, and the current amplifier 124 increases the scanning pulse current so that it is of suitable magnitude to drive all of the series-connected emitters 90.

This description turns now to the exemplary sensor $S_{1,1}$ shown in FIG. 5*a*. The light emitted by the infrared emitter 90 is detected by the associated detector 94. The detector receives light of maximum intensity when the passage 60 is unobstructed by a token. The detector output voltage is directly proportional to the intensity of light received from the emitter 90. The detector output is applied to a column output line 127 for transmission to a cascode amplifier 128. The output of the amplifier 128 is applied to one input of a comparator 129 of the Schmitt trigger type. The amplifier 128 and comparator 129 are operatively associated so that whenever the detection passage 60 of sensor $S_{1,1}$ is unobstructed by a token 42, the amplified output 35 voltage of the detector 94 will exceed a threshold voltage $V_{th}$, which is applied to another input of the comparator 129, and will cause the comparator to produce a low or logic 0 output. The comparator 129 output is applied to input port 160 of the microcontroller controller 100.

Should a token block the infrared light from the emitter 90 (as shown in dashed lines of FIG. 5*a*), the amplified output voltage of detector 94 will drop beneath the threshold voltage $V_{th}$ applied to the comparator 129. As a result, the comparator places a high or logic 1 signal on the input port 160 of the microcontroller 100. In short, a logic 1 on input port 160 indicates a token has passed through the detection passage 60 of opening $O_{1,1}$; a logic 0 on the input port 160 indicates that the passage received no token.

The outputs of the detectors of sensors $S_{1,2}$ through $S_{1,5}$ are processed in the same manner as that just described with respect to sensor $S_{1,1}$. Accordingly, each detector output from sensor $S_{1,2}$ through $S_{1,5}$ is applied to a column output line 137, 147, 157, 167, respectively; amplified via a cascode amplifier 138, 148, 158, 168, respectively; and applied to an input of a comparator 139, 149, 159, 169, respectively. The output of each of those comparators is respectively applied to the microcontroller input ports 170, 180, 190, 200.

The microcontroller scans one row of sensors at a time, but reads all input ports 160, 170, 180, 190, 200 simultaneously. If a logical 1 is read on one or more of those input ports, the microcontroller 100 searches internal memory for the previously stored score value associated with the opening(s) 38 in the scanned row that corresponds to the column for which a logic 1 was read. The score is added to the existing round score and transmitted to the LED display 116 on the display board 32.

Upon completion of the scanning of row 1, the microcontroller 100 sequentially scans the remaining rows 2 through 4 by sequentially applying a scanning pulse to its output ports 121, 122, 123, respectively. As before, each pulse is amplified by a current amplifier 134, 144, 154, respectively, and applied to an associated row line 136, 146, 156, respectively. During the time each row is scanned, the microcontroller input ports 160, 170, 180, 190 and 200 are simultaneously read to determine whether one or more logic l'are present, and the round score is adjusted accordingly.

The frequency with each the row line is scanned once approximately every five milliseconds. This frequency is high enough to ensure that no tokens will pass through a chute 40 undetected, even if two or more tokens are received within the openings 30 at substantially the same time.

The score control system of the present invention is designed to ensure that any token 42 passing through a detection passage 60, is counted only once. Specifically, after the microcontroller 100 scans a particular row, the values read at inputs 160, 170, 180, 190 and 200 (i.e., logic 1 indicating token presence and logic 0 indicating no token) are compared with the input port values read during the previous scanning of that row. The microcontroller 100 will adjust the player's score for any logic 1 read at a given input port, only if the value of that particular port read during the previous scanning of the row was a logic 0. It can be appreciated that by determining for two successive row scans whether a transition from a logic 0 to a logic 1 has been detected for any given input port, a single token passing through a detection passage 60 will be counted only once.

During a player's turn it may occur that one pitched token strikes a previously pitched token that landed near, but did not fall into an opening. Consequently, two tokens may slide in tandem through the detection path 60, such as illustrated in FIG. 53*a* as tokens 42 and 42'. For such a situation, it is desirable to award a score for both tokens; however, two contacting tokens sliding through the detection path would provide a substantially continuous blockage of the emitter 90 if the emitter were aligned with the passage center line 202 (see FIG. 3). It has been found, however, that the emitter blockage will be adequately interrupted (hence, the microcontroller 100 apprised of the presence of two tokens) if the centers of the emitters 90 and detectors 94 are offset a distance *d* from the center line 202 of the detection passage. Preferably, the distance *d* is established at approximately 75% of the radius of the token.

A player's turn is complete after all of the tokens have been tossed for that round, or after expiration of the time remaining on the game timer display. The player control switch 106 is depressed and the player's round score is added to the game score and displayed via the appropriate LED 118 on the display board 32. Unless all rounds have been completed, play continues with the next player.

While the preferred embodiment of the invention has been illustrated and described, it will be appreciated that various changes can be made therein without departing from the spirit and scope of the invention as set forth in the appended claims.

We claim:

1. In a game apparatus that includes a target member that has a plurality of openings, wherein the openings are formed to receive tokens that are pitched toward the target member, and wherein the openings are arranged on the target member in a matrix of multiple rows and multiple columns, a scoring system comprising:

a plurality of chutes, each chute having a first end connected to the target member near an associated opening and configured to move tokens that are pitched into the associated opening through a detecting passage formed within the chute;

a sensor fastened to each chute and selectively activated for providing on one of a plurality of output lines a first detection signal whenever a token passes through the detection passage of the chute to which the sensor is fastened; each column of sensors being connected to a common output line; and score control means for:

(a) sequentially activating each row of sensors;

(b) simultaneously monitoring the output lines to receive a first detection signal provided by any of the sensors associated with the activated row of sensors;

(c) generating a score signal in response to the received first detection signals, the score signal including the particular detection passage through which each pitched token moves.

2. The scoring system of claim 1 wherein the detection passage of each chute has a cross-sectional shape substantially corresponding to the central cross-sectional shape of a coin-like token, and wherein each detection passage has a center line substantially aligned with the center of the token that passes therethrough, and wherein the sensor associated with a detection passage is fastened on one side of the center line for providing detection signals indicative of two or more distinct tokens that pass substantially in tandem through the detection passage.

3. The scoring system of claim 2 wherein each sensor comprises a single light emitter and a single light detector.

4. The scoring system of claim 2 wherein a second detection signal is provided on the associated output line by each activated sensor whenever no token is present in the detection passage of the chute to which the sensor is fastened, and wherein the score control means revises the score signal corresponding to a particular detection passage whenever a first detection signal provided by any one sensor of an activated row of sensors was preceded, during the previous monitoring of the activated row, by a second detection signal provided by that one sensor.

* * * * *

UNITED STATES PATENT AND TRADEMARK OFFICE

CERTIFICATE OF CORRECTION

PATENT NO. : 4,893,821

DATED : January 16, 1990

INVENTOR(S) : Mariano deOrbegoso, Jane Moe, and Chris Masterson

It is certified that error appears in the above-identified patent and that said Letters Patent is hereby corrected as shown below:

Column 4, line 38, change "40ajust" to --40a just--.

Column 5, line 61, delete "35".

Column 6, line 38, change "1'are" to --1's are--.

Column 6, line 44, change "30" to --38--.

Signed and Sealed this

Eighth Day of January, 1991

*Attest:*

HARRY F. MANBECK, JR.

*Attesting Officer*

*Commissioner of Patents and Trademarks*